US005575116A

United States Patent [19]

Carlson et al.

[11] Patent Number: 5,575,116

[45] Date of Patent: Nov. 19, 1996

[54] WINDOW VENT STOP

[75] Inventors: Dennis Carlson, McPherson, Kans.; Jeffrey B. Hersh, Wayne, Pa.; Dennis Westphal, Parma, Mich.

[73] Assignee: CertainTeed Corporation, Valley Forge, Pa.

[21] Appl. No.: 470,957

[22] Filed: Jun. 6, 1995

[51] Int. Cl.[6] ..... E05B 55/00

[52] U.S. Cl. ..... 49/449; 49/417; 49/450; 49/465

[58] Field of Search ..... 49/175, 417, 419, 49/450, 465, 449

[56] References Cited

U.S. PATENT DOCUMENTS

| | | | |
|---|---|---|---|
| 2,495,713 | 1/1950 | Foster | 49/417 |
| 3,103,713 | 9/1963 | Ahlgren | 49/449 |
| 4,034,510 | 7/1977 | Huelsekopf | 49/419 |
| 4,171,835 | 10/1979 | Conley | 49/450 |
| 4,586,291 | 5/1986 | Swan | 49/501 |
| 4,825,595 | 5/1989 | Bancroft | 49/419 |
| 4,837,975 | 6/1989 | Simpson | 49/449 |
| 4,901,475 | 2/1990 | Simpson | 49/449 |
| 5,064,230 | 11/1991 | Ornduff, Sr. | 49/449 |
| 5,165,737 | 11/1992 | Riegelman | 49/176 |
| 5,265,308 | 11/1993 | May et al. | 49/419 |

OTHER PUBLICATIONS

Ashland Products Trade Literature entitled "Single & Double Hung Slider Casement", Ashland Products, Chicago, Illinois, undated.

*Primary Examiner*—Kenneth J. Dorner
*Assistant Examiner*—Curtis A. Cohen
*Attorney, Agent, or Firm*—Duane, Morris & Heckscher

[57] ABSTRACT

Window vent stop devices are provided by this invention which include housing and stop block portions in which the stop block is pivotally mounted within the housing to provide a first position for permitting at least one of the sashes of a window to slide freely by the other, and a second position which causes the stop block to impinge against the other sashes to limit the sliding movement of the sashes. The stop block includes an integral spring arm to assist it in moving from the first and second positions.

19 Claims, 3 Drawing Sheets

WINDOW VENT STOP

FIELD OF THE INVENTION

This invention relates to locking mechanisms for windows, and in particular to mechanical lock stops used to control the degree to which sashes in a window may be opened relative to one another.

BACKGROUND OF THE INVENTION

Window assemblies typically include a frame and a pair of sashes mounted for reciprocal vertical or horizontal sliding movement, one relative to the other, on guide rails in a frame jamb. These assemblies can also include sash locks, security locks or locking assemblies which are either spring-loaded or manually activated to secure the window sashes or panels in a locked, closed position.

Many of today's modern windows include vinyl, vinyl-clad aluminum extrusion or vinyl-clad wooden sashes containing vent stops. Vent stops are typically mounted on the inside surface of the upper sash and are manually activated to extend from a flush position to an extended position over the top rail of the lower sash. This permits the windows to move relative to one another to provide a vent opening through the window, but limits the size of the vent opening. Vent stops can reduce burglaries since they can be positioned to permit a relative opening which is too small for the torso of a human being. They also minimize the risk of small children falling through open windows, since they can be positioned on one of the sashes to create a vented opening which is even too small for children.

Most vent stops contain an internal metal spring which creates a biasing action so that the stop can be selectively placed in an extended open position. Since the metal spring is an additional cost item, requires additional assembly time and is subject to corrosion, a need presently exists for a better biasing mechanism. In order to be accepted in the window trade, such a mechanism must be capable of a minimum of 4,000 cycles of use prior to failure.

SUMMARY OF THE INVENTION

A window vent stop device is provided by this invention which is suitable for single-hung, double-hung, single slider, or double slider windows. The device includes a housing and a stop block pivotally mounted therein. The stop block includes an integral spring arm for permitting it to project selectively beyond the housing to restrain the relative movement of the sashes in the window.

The window vent stop of this invention can be made of molded polymers. In the preferred embodiment, a molded stop block containing an integral spring arm is mounted within a one-piece plastic housing. The traditional metal spring, often used in vent stops, can be completely eliminated, which saves on assembly time and the cost of the materials. The integral spring arms of this invention have not only superseded the 4,000 cycle minimum industry standard, but have provided greater than 10,000 cycles of use, and up to and exceeding 18,000 cycles of use, before failure.

In other embodiments of this invention, a window is provided having a support structure including a sill and a pair of vertical jambs. The window includes a pair of movable sashes disposed in adjacent parallel tracks located on the jambs for permitting the sliding of the sashes relative to one another. A vent stop device is mounted to a first of the sashes. This device comprises a housing and a rail stop block disposed within the housing. The rail stop block includes a button portion and an integral spring arm for permitting it to selectively extend from the first sash to contact a surface of the second sash to limit the degree to which the sashes can be opened to form a vent opening through the window.

A BRIEF DESCRIPTION OF THE DRAWINGS

The accompanying drawings illustrate preferred embodiments of h invention as well as other information pertinent to the disclosure, and in which.

A DETAILED DESCRIPTION OF THE INVENTION

This invention provides vent stop devices for limiting the degree sashes in single and double hung windows can be moved relative to one another to provide a vent opening. Preferably the vent stop device is flushly mounted to the stiles of the upper sash.

Figure 1:
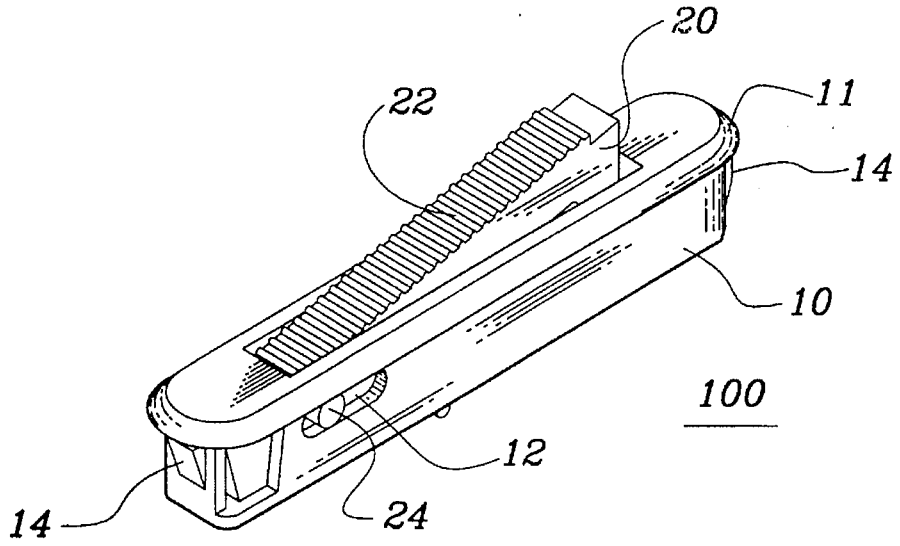
FIG. 1 is front perspective view of a preferred window vent stop device of this invention.
Figure 2:
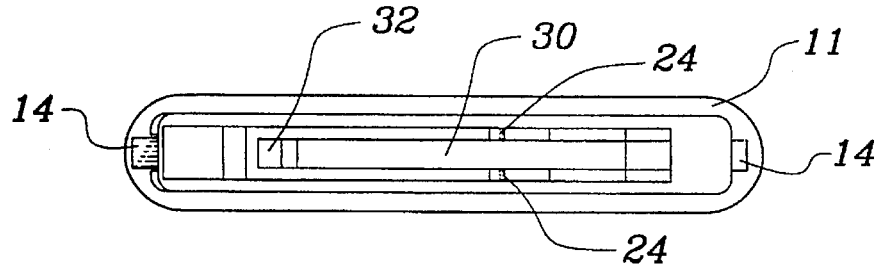
FIG. 2 is a bottom plan view of the vent stop device of FIG 1.
Figure 3:
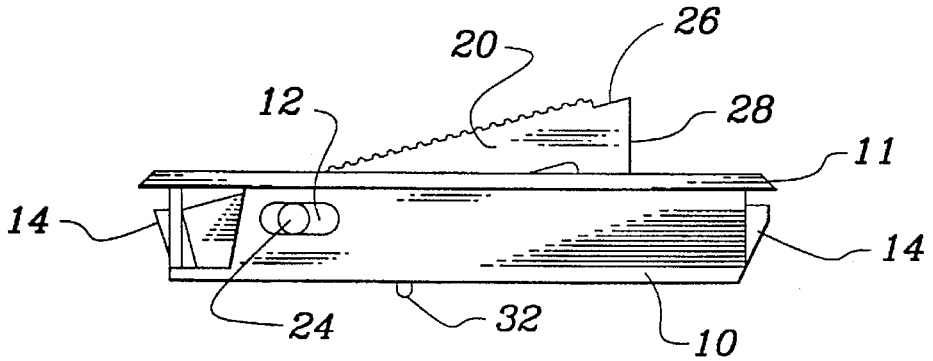
FIG. 3 is a side plan view of the vent stop device of FIG. 1.

With reference to the figures and more particularly to FIGS. 1–3 thereof, the preferred vent stop device 100 will now be described. The vent stop device 100 includes a housing 10, shown in FIG. 2 as an ovally-shaped construction having a flanged rim 11 and a pair of self-mounting clips 14 located at each longitudinal end of the housing 10. The housing 10 has an internal cavity for receiving a stop block, and more preferably, a rail stop block 20 for contacting a rail surface of an opposing sash.

The rail stop block 20 is pivotally mounted within the housing 10 to provide a first position which permits one or more sashes of a single or double hung window, for example, to slide freely by one another, and a second position, which causes the rail stop block to impinge against one of the rails of the sashes to limit a sliding movement of the sash or sashes. Rail stop block 20 is shown in this second position in FIG. 3. The pivoting movement of the rail stop block 20 can be provided by a hinge pin 24 located within a pair of ovally-shaped apertures 12 through the sidewall of the housing 10.

The rail stop block 20 includes a button surface 22, which exhibits a series of horizontal ridges or corrugations which facilitate the manual activation of the vent stop device 100 with a fingernail or fingertip of a user. By pushing the rail stop block 20 so that the latch surface 26 clears the inside surface of the housing 10, the rail stop block 20 is urged to move outwardly from the housing 10 by an integral spring arm 30.

In a preferred embodiment, the integral spring arm 30 comprises an extended portion of the rail stop block which forms an acute angle with the remaining portion thereof. When the rail stop block 20 is in a first or closed position, the integral spring arm 30 compresses against an inner surface of the glass, sash profile, or housing 10 to which it is mounted, preferably a glass surface of the window of that sash. This creates a spring force which helps to push the rail stop block 20 outward from the housing 10 when activated. The integral spring arm 30 can be equipped with a terminal end 32, shown as a rounded projection, which helps to smoothly guide the integral spring arm 30 along the glass surface.

Figure 5:
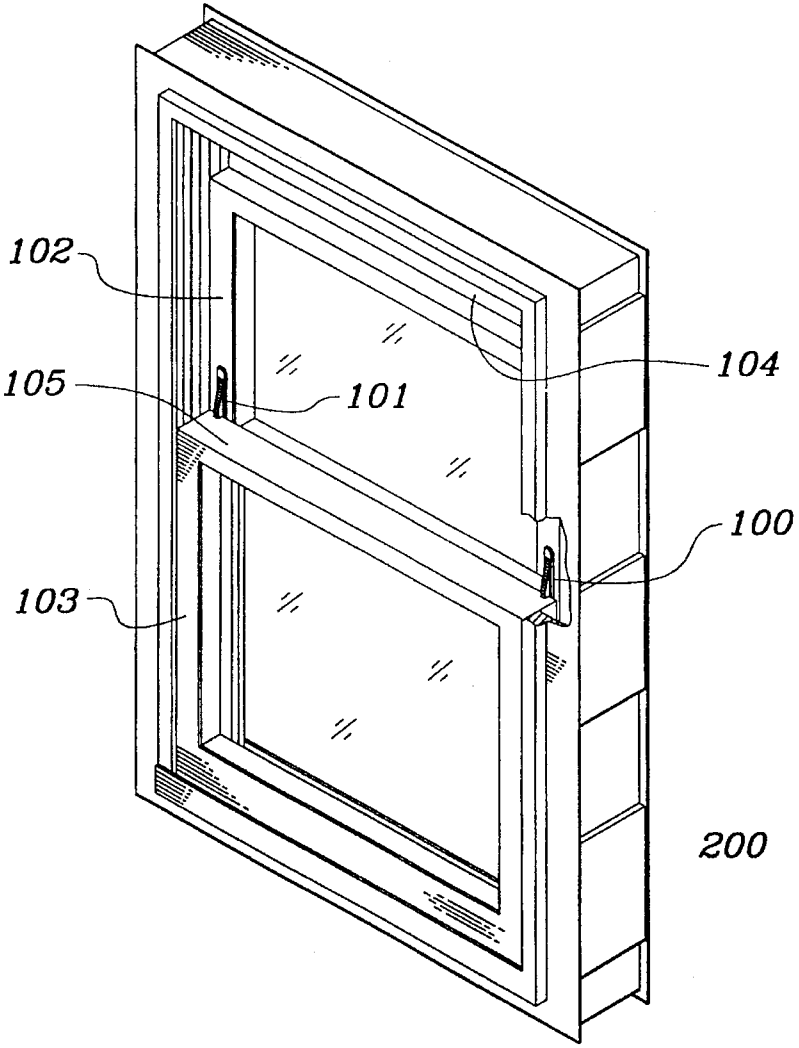
FIG. 5 is the double-hung window of FIG. 4, after the upper sash has been lowered to provide a vent opening through the window.
Figure 4:
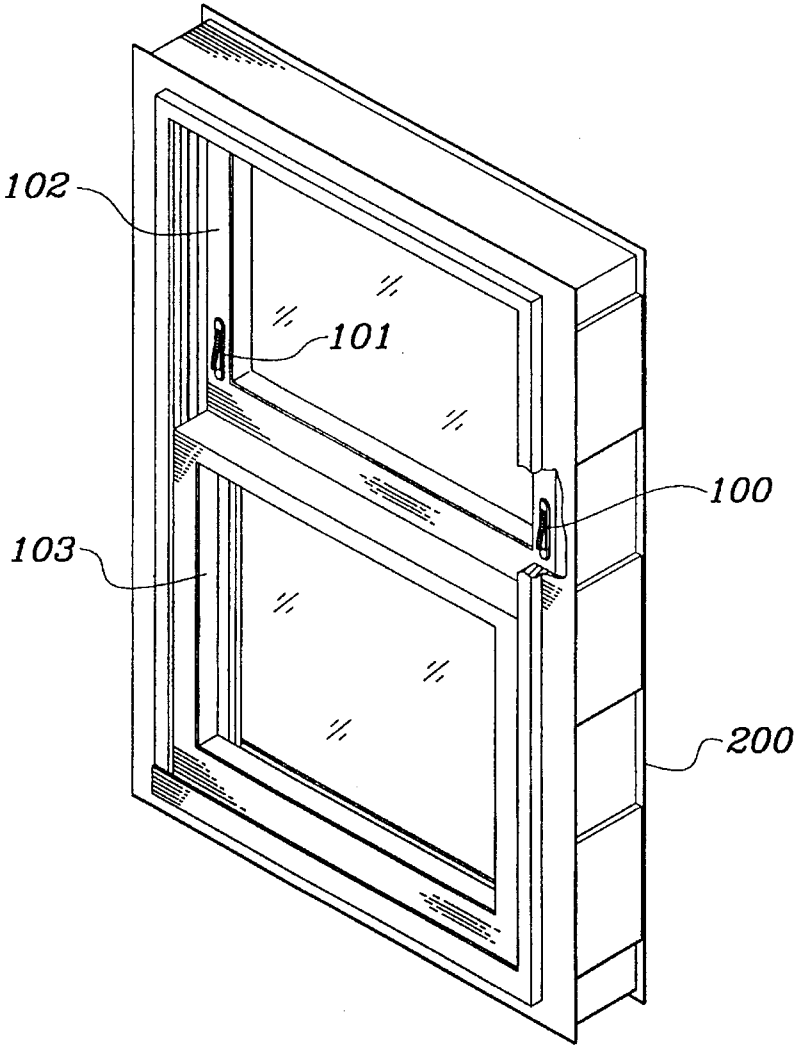
FIG. 4 is a front perspective view of a double-hung window incorporating a pair of vent stop devices of this invention in its upper sash.

As shown in FIGS. 4 and 5, a window 200 can be equipped with a pair of vent stop devices 100 and 101. The window 200 includes some typical features, including a pair of vertical jambs and a sill. Mounted within the window are two sashes 102 and 103, although it is envisioned that one, three or more moving sashes can be provided depending on the window design. Sashes 102 and 103, of window 200 are disposed in adjacent tracks located on the window jambs for permitting them to slide relative to one another. The vent stop devices 100 and 101 are preferably provided on the inside surface of the stiles of the upper sash 102 at approximately the same height so as to contact the rail surface 105 of the lower sash 103 at the same time. Alternatively, the rail stop block devices 101 and 100 can be mounted at different distances from the rail surface of the movable sash so as to enable selective vent openings by opening them individually.

When the vent stop device 100 is employed, the integral spring arm 30 pushes the rail stop block outward from the surface of the style of the upper sash 102. As the upper sash 102 is lowered, or the lower sash 103 is raised, the rail surface 105 contacts the rail contact surface 28 of the rail stop block 2, as shown FIG. 5. This defines a pre-set vent opening 104, since the relative sash movement is encumbered. This vent limiting control can be effective if the window is in either a vertical or horizontal position.

Figure 7:
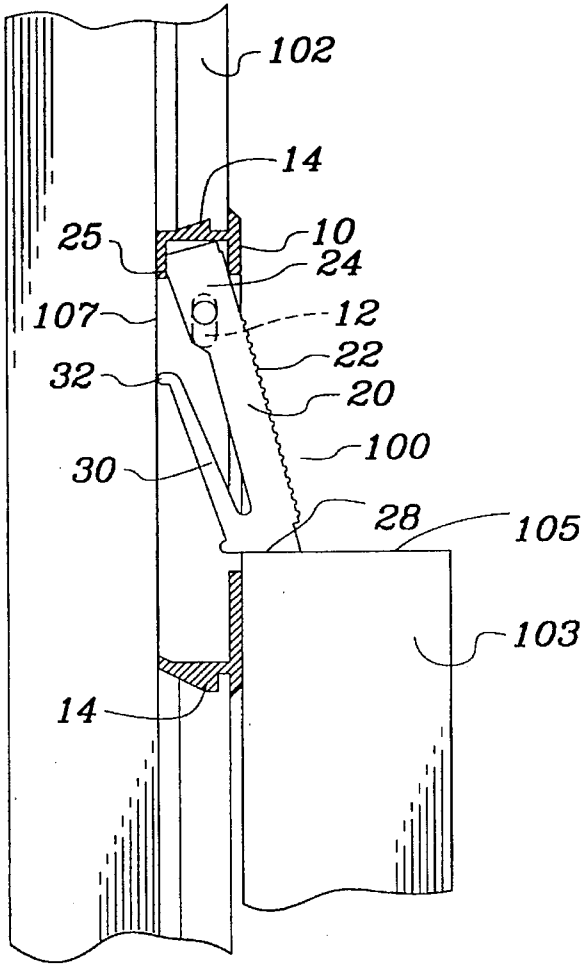
FIG. 7 is a cross-sectional view of the window of FIG. 6 showing the same vent stop device in an open position above the rail of the lower sash.
Figure 6:
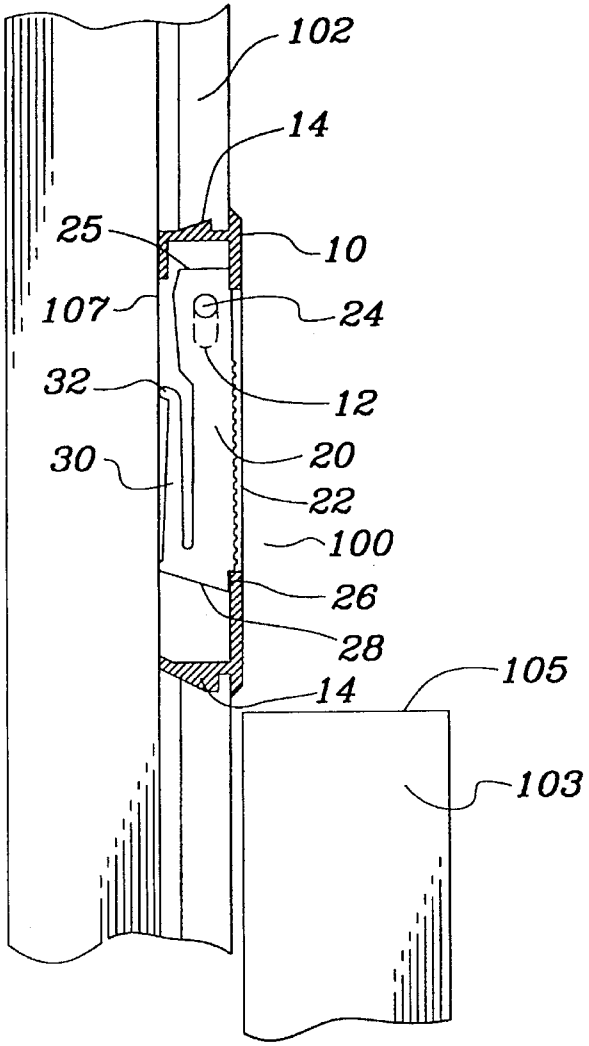
FIG. 6 is a cross-sectional view of the upper sash of the window of FIG. 4 showing one of the vent stop devices in a closed position.

With reference to the cross-sectional views of FIGS. 6 and 7, the operation of the preferred vent stop device 100 will now be more fully described. In the first, or closed position, shown in FIG. 6, the latch surface 26 of rail stop block 20 is pressed beneath the housing 10 so that the integral spring arm 30 is compressed against the glass surface 107. In this closed position, the hinge pin 24 is located near the middle of the ovally-shaped aperture 12, shown in phantom. The upper and lower sashes 102 and 103 can then slide relative to one another without hitting the housing 10 or the rail stop block 20.

When the rail stop block 20 is moved into the second, or open position shown in FIG. 7, the hinge pin 24 is pushed upward in the ovally-shaped aperture 12, also in phantom, so as to release the latch surface 26 from beneath the housing 10. This permits the integral spring arm 30 to release its potential spring energy, forcing the rail contact surface 28 to extend from the housing 10. During this sliding motion, the terminal end 32 of the integral spring arm 30 slides slightly downward along the glass surface 107, and the rail stop block 20 is pushed slightly vertically and rotated counterclockwise as shown in FIG. 7. This causes the rear stop block 25 near the top of the rail stop block 20 to impinge on the lower surface of the housing 10. The rear stop block 25 helps to keep the rail stop block 20 from rotating too far out of its housing 10 and locks it into position so as to prevent movement when the rail surface 105 of the lower sash 103 comes into contact with the rail contact surface 28. In this open position, either sash can be moved to create a vent opening through the window.

The vent stop devices of this invention preferably are made from a thermoplastic polymer. The preferred construction includes only two pieces, the housing 10 and rail stop block 20, which can be injection molded at low cost. The use of an integral spring arm 30 eliminates the metal springs of the prior art, saves in manufacturing labor costs, and reduces corrosion. The resulting rail stop blocks can be operated over 10,000 cycles without failure, and in certain cases, greater than 18,000 cycles. The preferred device is made from a polycarbonate resin, which is known to have a high yield point and great resistance to fatigue.

From the foregoing, it can be realized that this invention provides improved vent stop devices which can be mounted into the sashes of single, double and triple hung windows, for example. The locking devices include integral spring arms designed to eliminate premature wear and high cost construction. These devices are simple to operate and can help minimize burglaries and injuries to small children venturing near open windows. Although various embodiments have been illustrated, this was for the purpose of describing, but not limiting the invention. Various modifications, which will become apparent to one skilled in the art, are within the scope of the invention described in the attached claims.

What is claimed is:

1. In a window having a support structure including a sill and a pair of vertical jambs, said window including a pair of sashes, including at least one movable sash which is disposed in tracks located on said jambs for permitting a sliding of said sash, the improvement comprising:

a vent stop device mounted to a first of said sashes, said device comprising a housing and a stop block disposed within said housing, said stop block comprising an integral spring arm for permitting said stop block to selectively extend out from said first sash to contact a surface of a second of said sashes to limit the degree to which said movable sash can be opened to form a vent opening through said window.

2. The window of claim 1 wherein said vent stop device is mounted to an inside surface of an upper sash of a vertically-hung window.

3. The window of claim 2 comprising a second vent stop device also mounted to said inside surface of said upper sash.

4. The window of claim 3 wherein said first and second vent stop devices are located on a pair of opposite stiles of said upper sash at approximately the same height.

5. The window of claim 1 wherein said vent stop device is mounted within a recess on a style of an upper one of said sashes.

6. The window of claim 5 wherein said integral spring arm comprises an extended portion of said stop block, said extended portion forming an acute angle with a remaining portion of said stop block.

7. The window of claim 6 wherein said extended portion of said stop block comprises a terminal end disposed against a glass panel of said first sash.

8. A window vent stop device for mounting within a first sash of a window having at least one moveable sash, said device comprising a housing and a rail stop block pivotally mounted within said housing to provide a first position which permits said moveable sash to slide freely, and a second position which causes said rail stop block to impinge against said moveable sash to limit the sliding movement of said moveable sash, said rail stop block comprising an integral spring arm to assist in moving said rail stop block from said first to said second position, said rail stop block being mounted to said housing by a transverse hinge located within a pair of ovally-shaped apertures in said housing.

9. The device of claim 8 wherein said rail stop block and integral spring arm comprise a one-piece, molded polymer.

10. The vent stop device of claim 9 wherein said integral spring arm comprises an extended portion of said rail Stop block which forms an acute angle with a remaining portion of said rail stop block.

11. The vent stop device of claim 8 wherein said integral spring arm comprises a terminal end for contacting a glass panel of said window.

12. The vent stop device of claim 8 wherein said rail stop block comprises a contact surface which is substantially parallel with a meeting rail surface of said second sash when said rail stop block is in said second position.

13. The vent stop device of claim 8 wherein said ovally-shaped apertures permit said rail stop block to be partially hidden within said housing in said first position.

14. The stopping device of claim 8 wherein said rail stop block comprises a button portion for facilitating manual activation.

15. The stopping device of claim 8 wherein said rail stop block comprises a polymer capable of achieving at least 10,000 bending cycles of use without failure.

16. A method of providing a vent opening in a double-hung window, comprising:

providing a window having a pair of sashes disposed within a support structure including a sill and a pair of vertical jambs, said window including at least one movable sash disposed in tracks located in said jambs for permitting the sliding of said sash relative to a second of said sashes, said window including a vent stop device mounted to said second sash, said vent stop device comprising a housing and a rail stop block disposed within said housing, said rail stop block comprising an integral spring arm for permitting said rail stop block to selectively extend out from said movable sash to contact a surface of said second sash to limit the degree to which said sashes can be opened to form a vent opening;

activating said rail stop block to extend it from said housing;

moving the relative position of said sashes to form a vent opening through said window, and to contact said rail stop block with said second sash.

17. The method of claim 16 wherein said movable sash is an upper sash of said window.

18. The method of claim 16 wherein said movable sash comprises a second sash-stopping means mounted to an inside surface thereof on an opposite stile of said first sash.

19. The method of claim 16 wherein said vent stop comprises a resilient polymer.

* * * * *